United States Patent [19]

Nelson

[11] Patent Number: 4,904,209

[45] Date of Patent: Feb. 27, 1990

[54] MODULAR PLUG COUPLER

[75] Inventor: Richard A. Nelson, Winston-Salem, N.C.

[73] Assignee: AMP Incorporated, Harrisburg, Pa.

[21] Appl. No.: 302,066

[22] Filed: Jan. 24, 1989

Related U.S. Application Data

[63] Continuation of Ser. No. 128,835, Dec. 4, 1987, abandoned.

[51] Int. Cl.[4] ..... H01R 23/02

[52] U.S. Cl. ..... 439/676; 439/655; 439/736; 439/638; 439/701

[58] Field of Search ..... 439/344, 676, 686, 687, 439/688, 692, 693, 695, 696, 701, 712, 723, 724, 638, 639, 650, 651, 652, 654, 658, 736

[56] References Cited

U.S. PATENT DOCUMENTS

| | | | |
|---|---|---|---|
| 4,029,388 | 6/1977 | Knoll | 339/218 R |
| 4,090,293 | 5/1978 | Van der Donk et al. | 29/628 |
| 4,153,327 | 5/1979 | Johnson | 339/91 R |
| 4,186,988 | 2/1980 | Kobler | 339/176 MP |
| 4,224,485 | 9/1980 | Krumreich | 200/51.1 |
| 4,268,109 | 5/1981 | Hardesty | 339/205 |
| 4,273,402 | 6/1981 | Hughes | 339/91 R |
| 4,295,702 | 10/1981 | Snyder | 339/97 P |
| 4,327,958 | 5/1982 | Hughes et al. | 339/276 SF |
| 4,367,908 | 1/1983 | Johnston | 399/154 A |
| 4,379,609 | 4/1983 | Hardesty | 339/91 R |
| 4,406,509 | 9/1983 | Jagen | 339/91 R |
| 4,444,451 | 4/1984 | Myers | 339/154 A |
| 4,460,234 | 7/1984 | Bogese | 339/128 |
| 4,593,966 | 6/1986 | Meyer | 339/205 |
| 4,632,493 | 12/1986 | Matsuzaki et al. | 439/676 |
| 4,703,991 | 11/1987 | Philippson | 439/676 |

FOREIGN PATENT DOCUMENTS 1163085 9/1969 United Kingdom .

OTHER PUBLICATIONS

"Modular Interconnection System" Catalog 78-515, revised 3-86.

"Printed Circuit Board Mounted Modular Jack" by Donald K. Hughes, (copyright 1980).

European Patent Office Search Report dated 10-88.

*Primary Examiner*—David Pirlot

*Attorney, Agent, or Firm*—Eric J. Groen

[57] ABSTRACT

A coupler for two modular plugs includes an insulative housing having two plug receiving opening for receipt of the modular plugs to be connected. A terminal assembly is included which incorporated a plurality of laterally spaced wire integrally held in a fixed array by a molded over web of insulative material. The connector housing is two part where the first part includes a rear face having a recessed pocket for the receipt of the web of material. A second housing half is snap latchable to the first housing half. The wires are formed into resilient contact portions with the contact portions disposed adjacent to the plug receiving openings for contact with the terminals on the modular plugs.

13 Claims, 11 Drawing Sheets

MODULAR PLUG COUPLER

This application is a Continuation of application Ser. No. 07/128,835 filed Dec. 4, 1987, now abandoned.

BACKGROUND OF THE INVENTION

1. Field of the Invention

The invention relates to a coupler of the type for interconnecting two modular plugs.

2. Description of the Prior Art

Couplers used for interconnecting two multiconductor telephone cables wherein each of the multiconductor cables includes a modular plug interconnected to the multiconductor cable are useful as a means for lengthening or splicing multiconductor cable. Such couplers are known in the art as taught by such references as U.S. Pat. Nos. 4,153,327; 4,268,109; 4,273,402; 4,367,908; 4,379,609; and 4,460,234. Most of these references teach using solid conductor wire formed in a variety of configurations to form two sets of resilient contacts such that the single wire can be used to interconnect the blade type contacts of two modular plugs. However, none of these references teach an inexpensive method for inserting the terminals within the housings, as all of the terminals are formed as individual contact members.

References such as U.S. Pat. Nos. 4,224,485; 4,295,702; and 4,406,509 teach inserts which hold a plurality of wires or contacts to the insert such that the insert can be installed within a housing for interconnection to a modular plug. In none of these references, however, is it taught to integrally mold the insert or web around the terminals for ease of manufacturing and ease of handling the terminals as a subassembly, and as a means for retaining the contacts within the housings. Rather the wires or terminals are individually inserted within the inserts.

A prior art coupler which includes a molded web over the terminals is shown in FIGS. 1A, 1B and 2. However, this coupler does not have a small front mating interface which makes it convenient and useable for a panel mountable electrical coupler. Rather the coupler includes like housing halves which makes the overall housing twice as large as a coupler which is inline. For panel mount purposes, the interface dimensions should be as small as possible in order not to waste panel space.

SUMMARY OF THE INVENTION

It is an object of the invention to design a modular plug coupler where the terminals are held in a fixed array within and retained within the housing.

It is an object of the instant invention to design a coupler for electrical plugs which allows the coupler to be panel mountable.

It is a further object of the instant invention to design a modular plug coupler having an easy assembly method.

Such an electrical coupler includes a first insulative housing member having a front mating face with a plug receiving opening therein and a rear face having a pocket recessed from the rear face. The housing also includes laterally aligned vertical grooves in the rear face which are in transition with channels which extend from the grooves to a position proximate the front mating face. The coupler also includes a second housing member which comprises a front mating face having a second plug receiving opening therein and the second housing member has a mounting face which abuts the rear face of the first housing member and a second plurality of laterally aligned grooves. A terminal subassembly is included which has a plurality of electrically conductive contact elements integrally encapsulated within a web of insulative material intermediate the ends of the contact elements. The subassembly is formed with the web profiled for receipt within the recessed pocket such that the web is parallel to the front mating face with the first ends of the contact elements disposed within the laterally aligned grooves and extending forward towards the front mating face. The contact elements are then reversely bent to extend diagonally inward thereby forming a first plurality of contact members. The terminal subassembly further comprises second ends of the contact elements extending in an opposite direction from the first said ends and the second ends include second reversely bent portions disposed within the second plurality of laterally aligned grooves thereby forming the second plurality of contact members.

BRIEF DESCRIPTION OF THE DRAWINGS

FIG. 5 is a view of the components of the inline coupler exploded away from one another.

DETAILED DESCRIPTION OF THE PREFERRED EMBODIMENT

Figure 3:
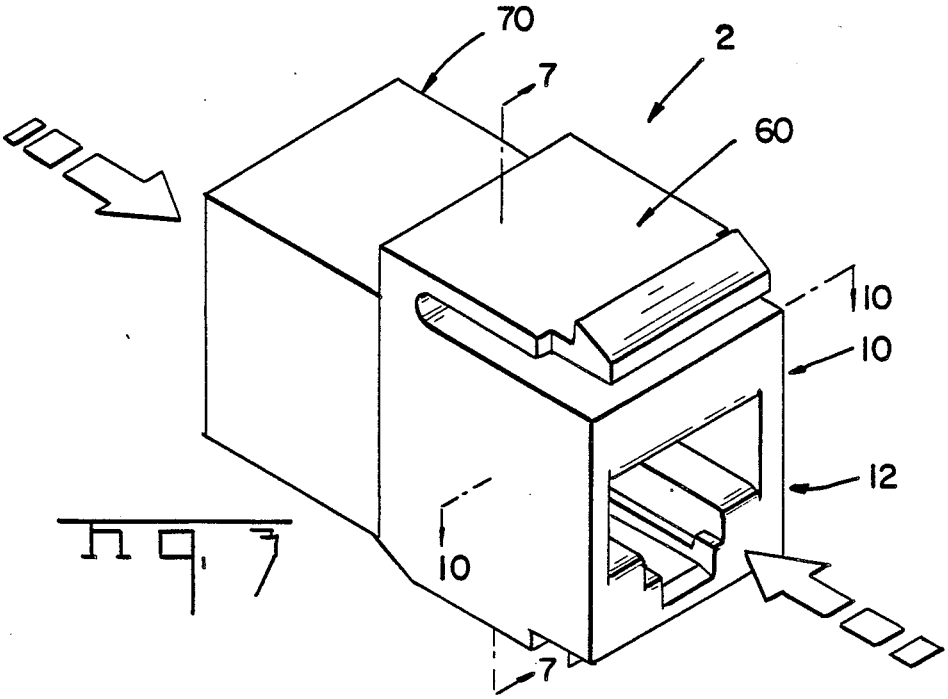
FIG. 3 is an isometric view of an inline modular plug coupler consistent with the subject invention.
Figure 4:
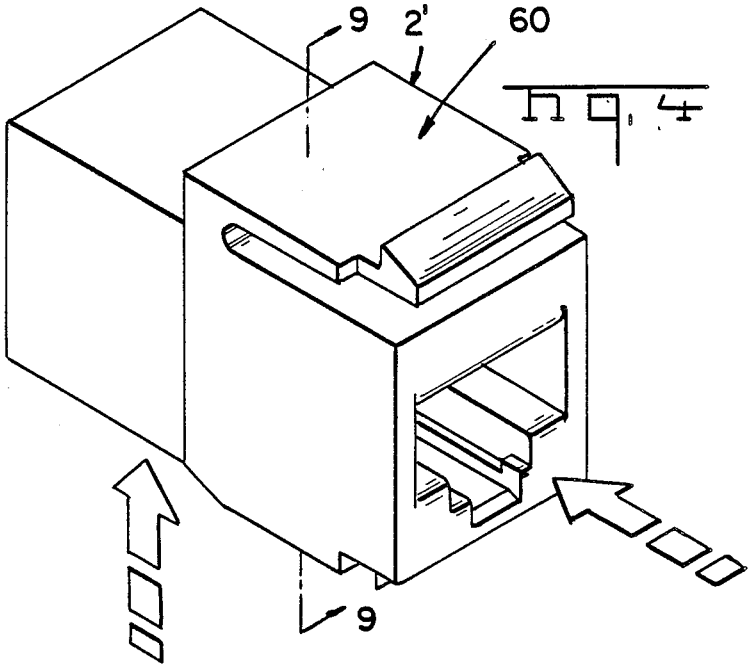
FIG. 4 is an isometric view of a right angle coupler poised for receipt of two modular plugs.

Referring first to FIGS. 3 and 4, couplers are shown as an inline coupler and a right angle coupler, respectively. In an inline coupler, the mating faces are along a common axial line and the plug receiving openings are parallel but rotated 180° along the axial line relative to each other. This allows the contacts of the electrical plug members to be correctly polarized. The right angle coupler includes two mating faces where the mating faces are disposed at right angles to each other.

Figure 7:
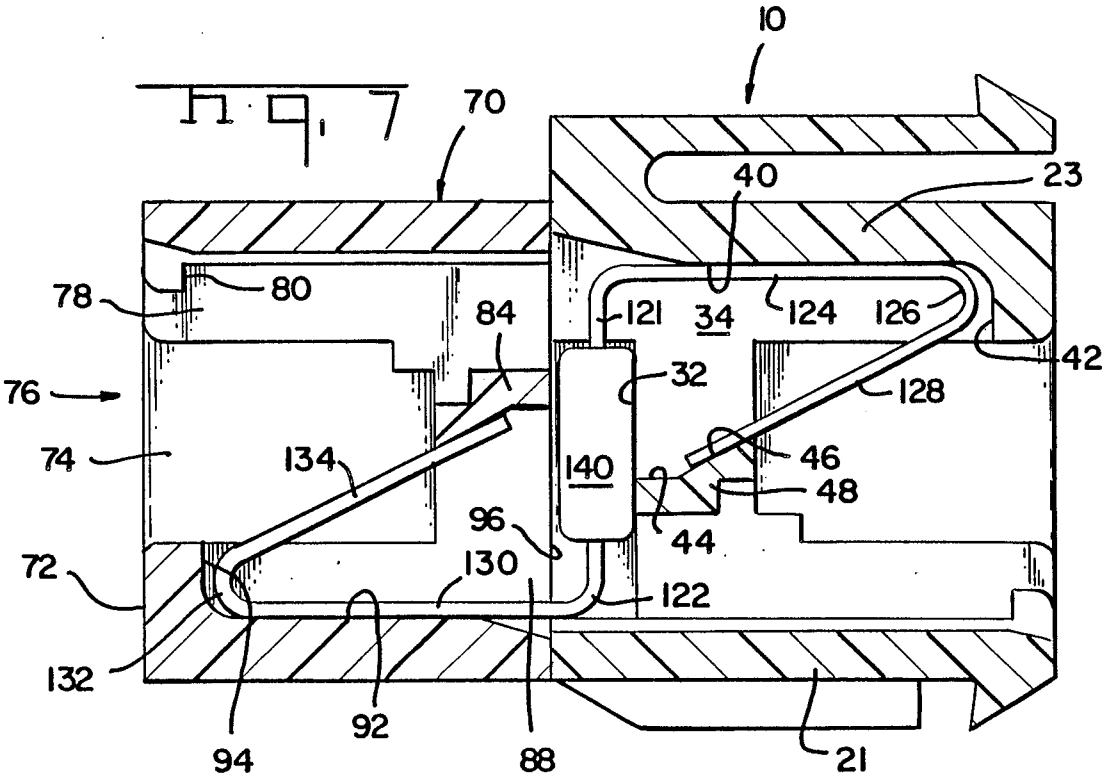
FIG. 7 is a cross-sectional view taken through lines 7—7 of FIG. 3.

Referring first to the inline coupler shown in FIG. 5, the inline coupler generally comprises a first housing member, such as 10, which is latchably connectable to a second housing member, such as 70, which traps between them a terminal subassembly, such as 120. The first housing member 10 generally includes a modular plug receiving opening 12 which extends inwardly from a front mating face 28 of the housing member 10 and is formed by two side walls, such as 14, and a lower floor 21 and upper wall 23 (FIG. 7). A through passageway is defined by inner parallel surfaces 16 which receives the resilient latch of the modular plug member. Latching shoulders 18 are included on the parallel surfaces 16 as latching members for the modular plug member.

Figure 6:
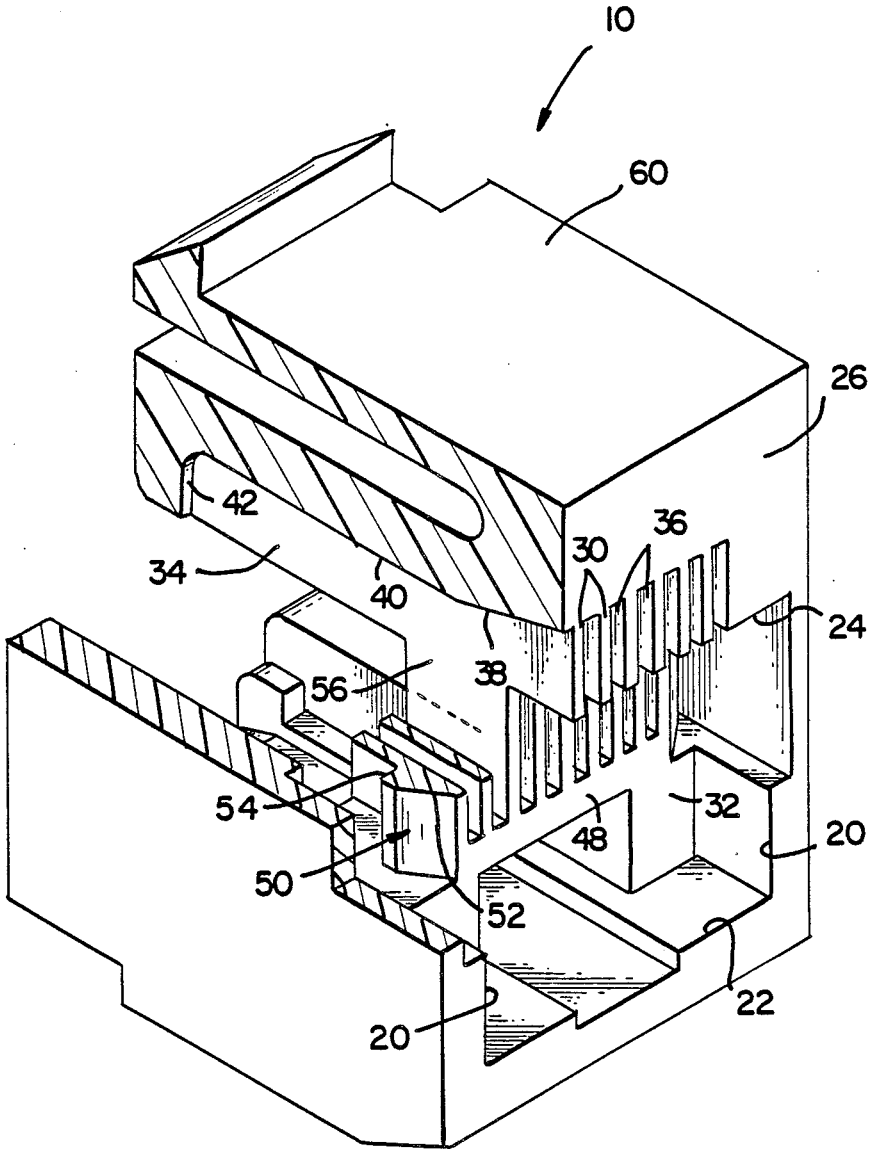
FIG. 6 is an isometric view of the first housing member partially cut away to expose the internal structure.

Referring now to FIG. 6 shows an isometric view of the first housing member 10 from the side exposing the rear face 26 and showing the first housing member 10 partially cut away to expose the inner structure. The rear face 26 includes a recessed pocket which is defined by side walls 20, lower wall 22, upper wall 24, and a recessed face, such as 32. A plurality of comb teeth, such as 30, define vertically extending grooves, such as 36, which extend a vertical distance from the rear face 26 downwardly into the pocket. A wall 56 is included as part of the inner structure of the first housing member and defines the inner extent of the plug receiving cavity as one surface and defines the recessed face 32 as the opposite exterior surface. Each of the grooves, such as 36, is in alignment and in communication with a channel, such as 32, which extends from the rear face forwardly to a position proximate the front mating face, each channel being defined by an upper surface, such as 40, and a rearwardly facing shoulder, such as 42. Two latching structures, such as 50, are cooperatively provided in an arrangement flanking the grooves 36 where each latch member includes an inclined surface, such as 52, and a forwardly facing shoulder 54. The forwardly facing shoulder 54 is accessible from the front mating face through the plug receiving opening.

With reference again to FIG. 5, the second housing member 70 includes a rear face, such as 96, having two resilient latching arms 98 extending therefrom, having ramped surfaces 100 and forwardly facing latch surfaces 102. The second housing member further includes a plurality of vertically extending comb members, such as 86, which define laterally aligned vertical grooves 88 which extend into the interior of the second housing member 70. A bridge portion 84 is integrally formed to integrate the combs 86 to the housing member and to provide stability of the comb members between the opposite side walls of the housing.

With reference now to FIG. 7, each of the grooves 88 which extend inwardly from the rear face 96 are in cooperation with a channel, such as 90, having a lower surface 92 and a rearwardly facing shoulder 94 adjacent the front mating face. Referring still to FIG. 7, the second housing member 70 includes a front mating face, such as 72, having side walls 74 thereby defining a plug receiving opening 76 therein. Parallel rails, such as 78, are included on the side walls 74 acting as the through passageway for the resilient latch of the modular plug member while rear facing shoulders 80 act as the latching surface for the modular plug latch member.

As shown in FIGS. 5 and 7, a terminal subassembly 120 is shown including a plurality of laterally spaced formed wire which includes an integral molded web 140 which spans a lateral extent of the wires and encapsulates the wires into a terminal subassembly. In other words, the subassembly is produced by insert molding; the formed wires are placed in a mold and the web material is injected into the mold cavity so that the web material encapsulates the wires. As shown in FIG. 7, each of the formed wires includes portions 121 and 122 extending out of opposite ends of the web member 140 where they are formed into perpendicular leg portions 124 and 130, respectively. The leg portions 124 and 130 extend outwardly away from the web portion to radiused portions 126 and 132 where they are reversely bent and formed into resilient contact members 128 and 134. As shown in FIG. 5, the terminal subassembly 120 is insertable through the rear face 26 of the first housing member 10 such that each of the terminals enters one of the grooves, such as 36, and is disposed within one of the channels 34. The terminal subassembly is insertable into the first housing member 10 until the integral web 140 is flush with the recessed face 32, as shown in FIG. 7. With reference still to FIG. 7, when the web is disposed within the recessed pocket, each of the legs 124 is disposed within one of the respective channels 34 and each leg 124 is in a substantially abutting relation with the top surface 40 of the channel. Furthermore, the radiused portion, such as 126, is adjacent the rearwardly facing shoulder 42 which places the radiused portion 126 adjacent to the front mating face. Also as shown in FIG. 7, the bridge portion 48, which is shown in FIG. 6, includes at the forward side a ramped surface, such as 46, which is cooperatively angled to receive the free end of the resilient contact portion 128 in an abutting manner. It should be noted from FIG. 7 that the channel 34 enlarges as the channel progresses rearwardly and, likewise, the profile of the terminal subassembly expands as the wire progresses from the radiused portion 126 rearwardly to the web. This allows the radiused portion of the wires which form the terminal subassembly 120 to be inserted from the rear face of the first housing member and are self-aligned within an associated channel 34. As shown in FIGS. 5 and 7, the grooves 88 at the rear face 96 of the second housing member 70 extend inwardly towards the central portion of the housing and are in alignment with channels, such as 90, having lower surfaces 92 and rearwardly facing shoulders 94. With the terminal subassembly placed within the first housing member with the web 140 positioned within the pocket of the first housing member 10, the second housing member 70 can be affixed to the first housing member 10 by aligning the grooves 88 at the rear face 96 of the second housing assembly 70 with the radiused portions 132 of the terminal subassembly. When the second housing member 70 is finally positioned relative to the first housing assembly 10, the rear face 96 of the second housing member 70 and the rear face 26 of the first housing assembly 10 are in an abutting relation thereby trapping the web 140 in a fixed position. Furthermore, each of the wires which extend from the web member 140 to form the second set of resilient contact portions are disposed in separate and associated channels 90.

Figure 10:
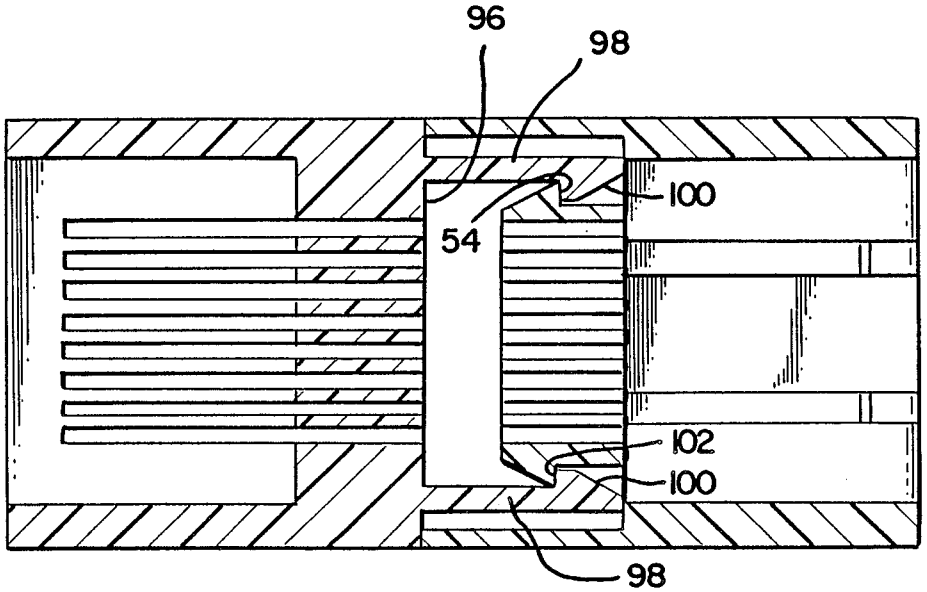
FIG. 10 is a cross-sectional view taken through lines 10—10 of FIG. 3.
Figure 11:
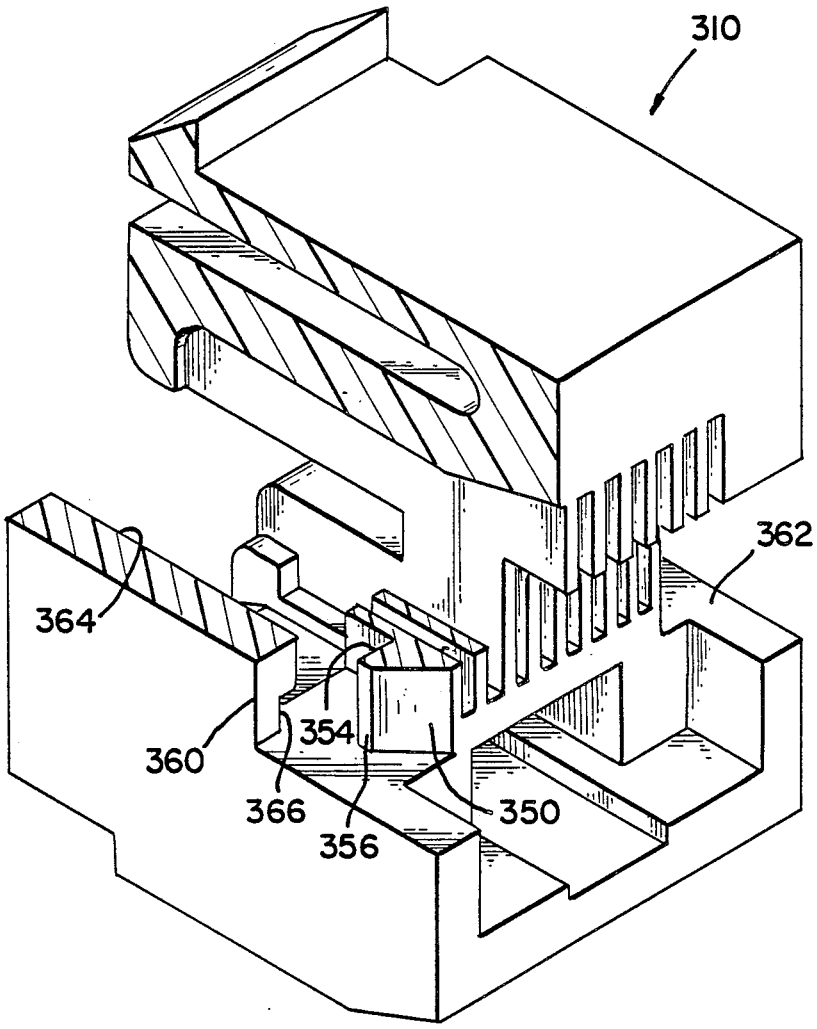
FIG. 11 is an isometric view of an alternate housing partially cutaway.

The two housings 10 and 70 are held together in a fixed position by means of the latching arms 98 being cooperable with the latch members, such as 50 shown in FIG. 6, to form a locked and latched condition, as shown in FIG. 10. As FIG. 10 is a cross-sectional view through lines 10—10 of FIG. 3, the latch arms 98 are shown in a latched condition such that the latching surfaces 102 of the latching arms 98 are latched behind the latch surface 54 of the latch members 50. As mentioned earlier, the forwardly facing latch surfaces 54 are accessible through the plug receiving opening of the first housing member 10. This allows the two housing members to be disassembled, if required, by placing members through the plug receiving opening to contact the inclined surfaces 100 of the latch arms 90 to bias the arms outwardly into an unlatched condition.

It should be noted from FIGS. 3 and 4 that each of the versions of the modular plug coupler includes a latching member, such as 60, which can latch the couplers to a profiled through hole in a panel for latchably retaining the coupler to the panel. Advantageously, the latching structure for the two housing members 10 and 70 is within the periphery or the interior of the housing, making the outside profile of the coupler easily insertable through an aperture in a panel.

Figure 9:
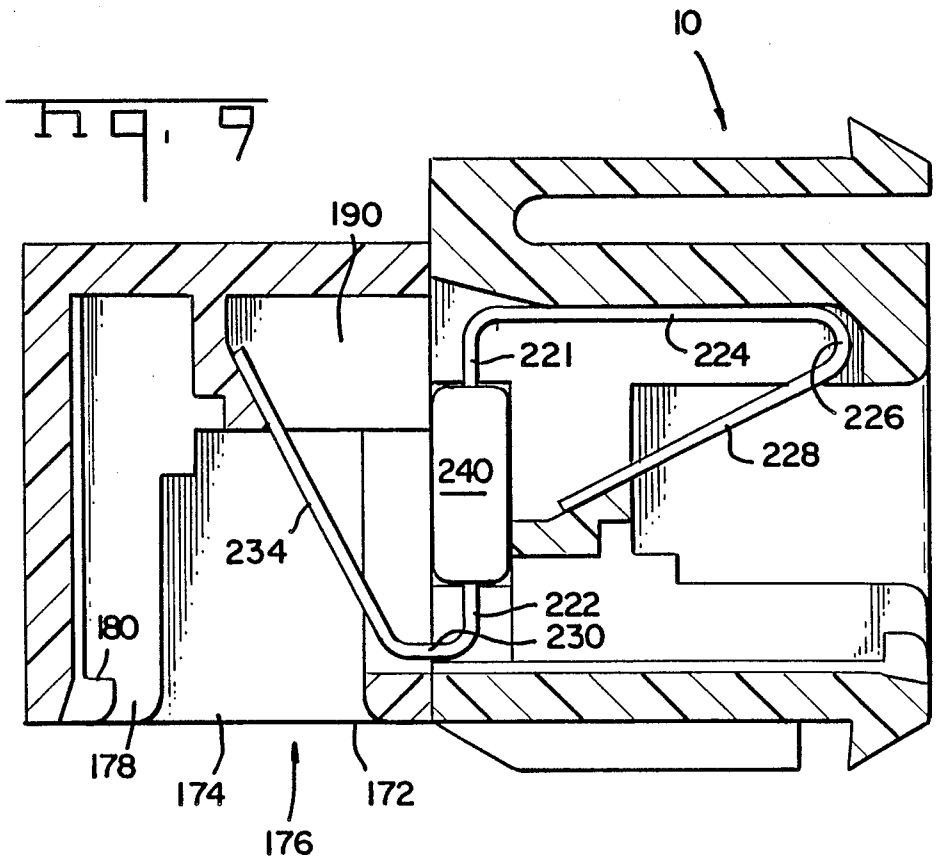
FIG. 9 is a cross-sectional view taken through lines 9—9 of FIG. 4.

Comparing FIGS. 7 and 9, it is shown that either an inline coupler or a right angle coupler is easily adaptable for use with the same first housing member 10. This is possible as the web portion 140 of the inline coupler or 240 of the right angle coupler is disposed in a parallel manner relative to the front mating face of the first housing member 10. This disposes terminal portions 121 and 122, or terminal portions 221 and 222 in a vertically separated position such that the upper terminal portions 121 or 221 are adjacent the interior of the upper wall and terminal portions 122 or 222 extend downwardly adjacent to the bottom wall of the second housing member. This allows the second housing member to either be formed into an inline coupler, as shown in FIG. 7, or include a reversely bent contact portion 234 to form a right angle coupler.

Figure 8:
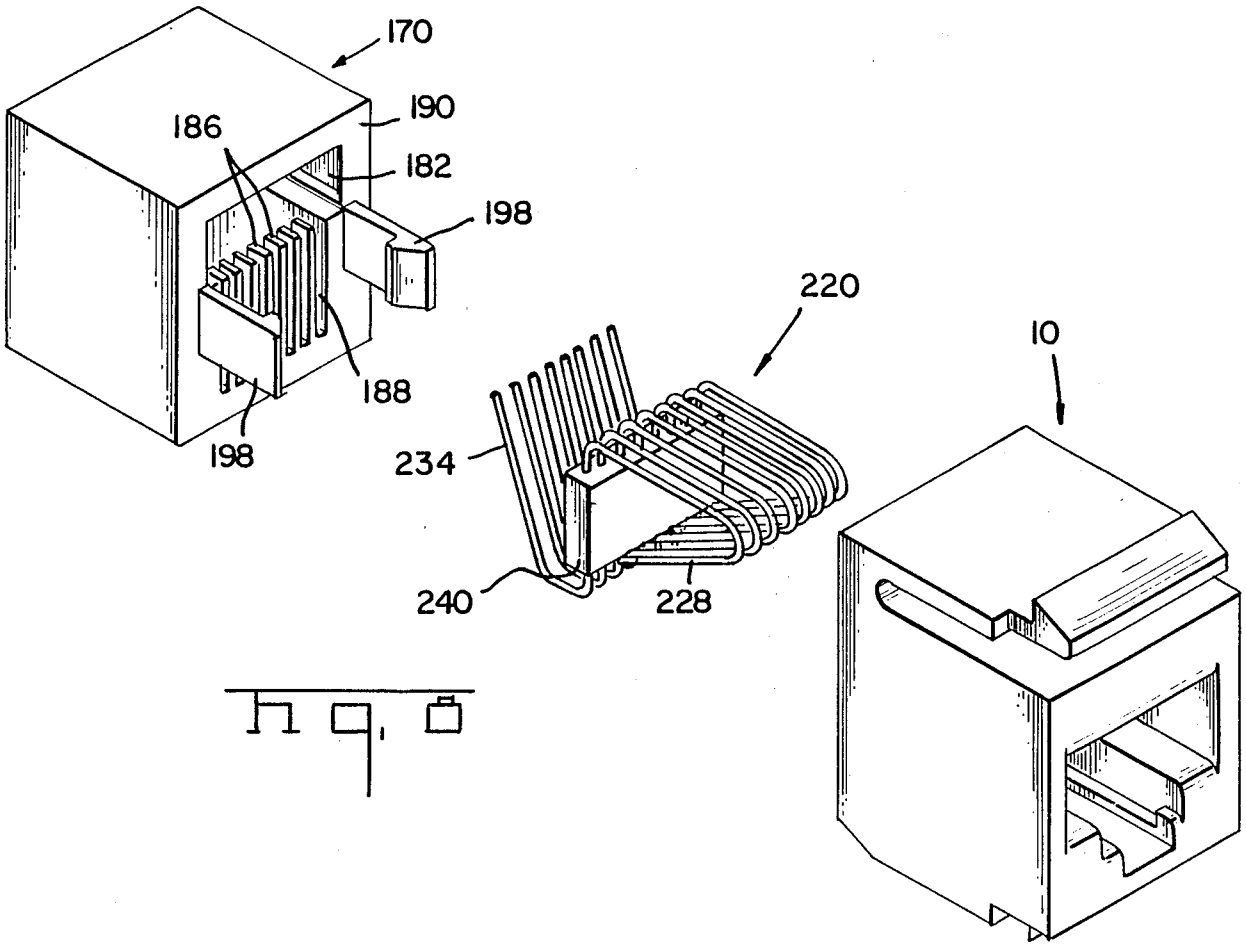
FIG. 8 is an isometric view showing the components of the right angle coupler, as shown in FIG. 4, exploded away from each other.

As shown in FIG. 8, the right angle coupler is quite similar to the inline coupler including a first housing member 10, a second housing member 170, and a terminal subassembly 220. The second housing member 170 includes similar comb members 186 thereby defining a plurality of vertically extending, laterally spaced grooves which extend inwardly to form a plurality of channels 190. The terminal subassembly 220 is similar to the terminal subassembly 120 of the inline coupler in all respects except that the leg portion 230 extends only a short distance where it extends diagonally upward to form ~~resilient~~ contact portion 234.

In ~~a similar~~ manner, the terminal subassembly 220 is insertable in through the rear face of the first housing member 10 with the web disposed within the pocket defined at the rear face of the first insulative housing member 10 and the second housing member 170 is insertable over the resilient contact portions 234 such that each resilient contact portion 234 is aligned with one of the vertically extending, laterally spaced grooves 188. Each of the latching members 198 are insertable into the first housing member 10 and are latched in a similar manner as that of the inline coupler.

Figures 1A, 1B:
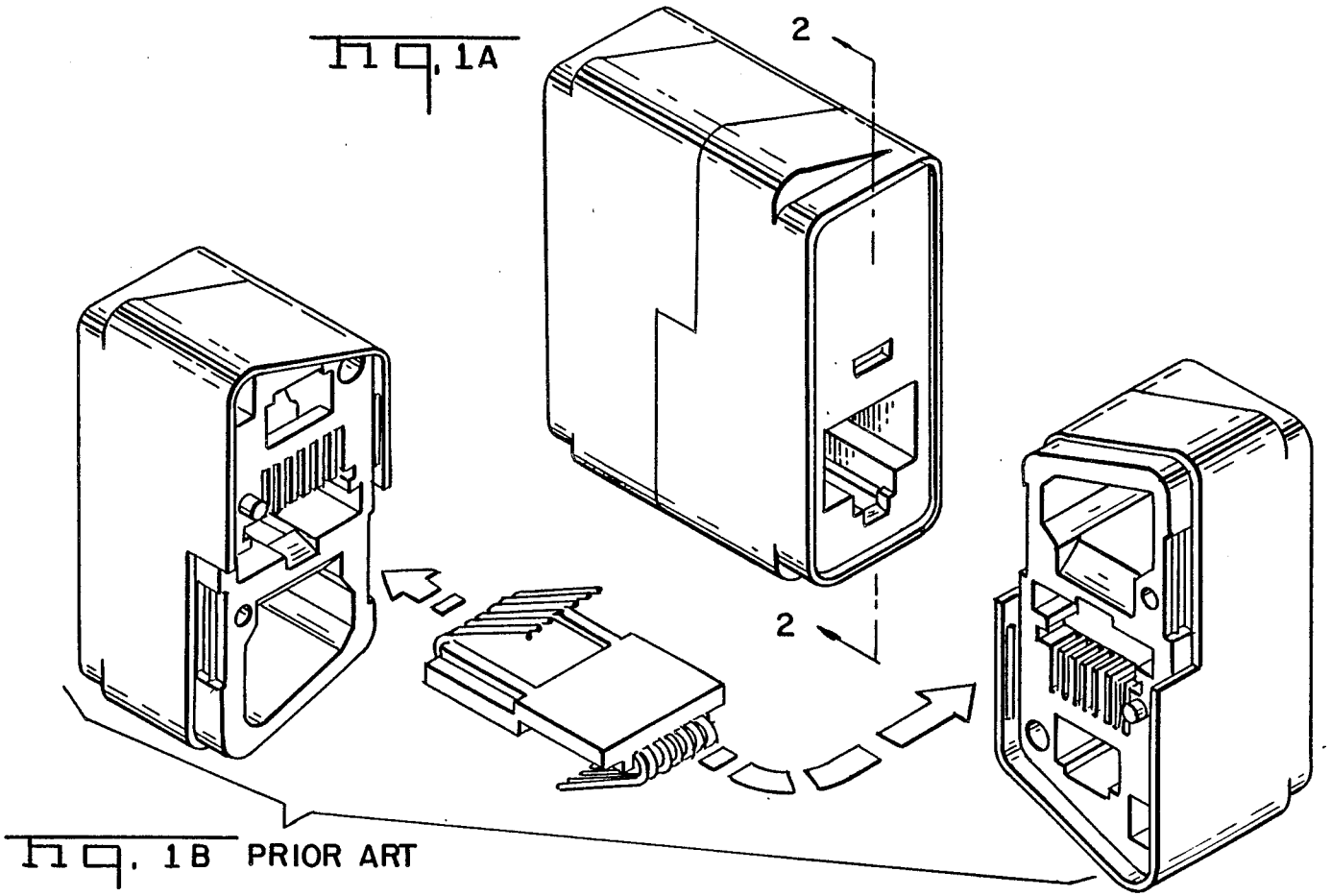
FIG. 1B PRIOR ART
FIG. 1A is an isometric view of a prior art coupler.
FIG. 1B is an exploded view of the coupler of FIG. 1B.
Figure 2:
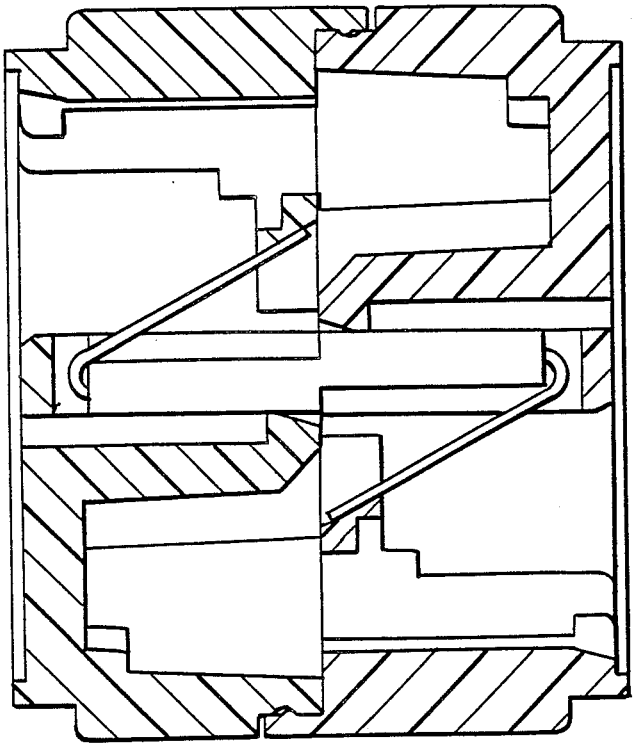
PRIOR ART Fig. 2
FIG. 2 is a cross sectional view through lines 2—2 of FIG. 1A.
Figure 1:
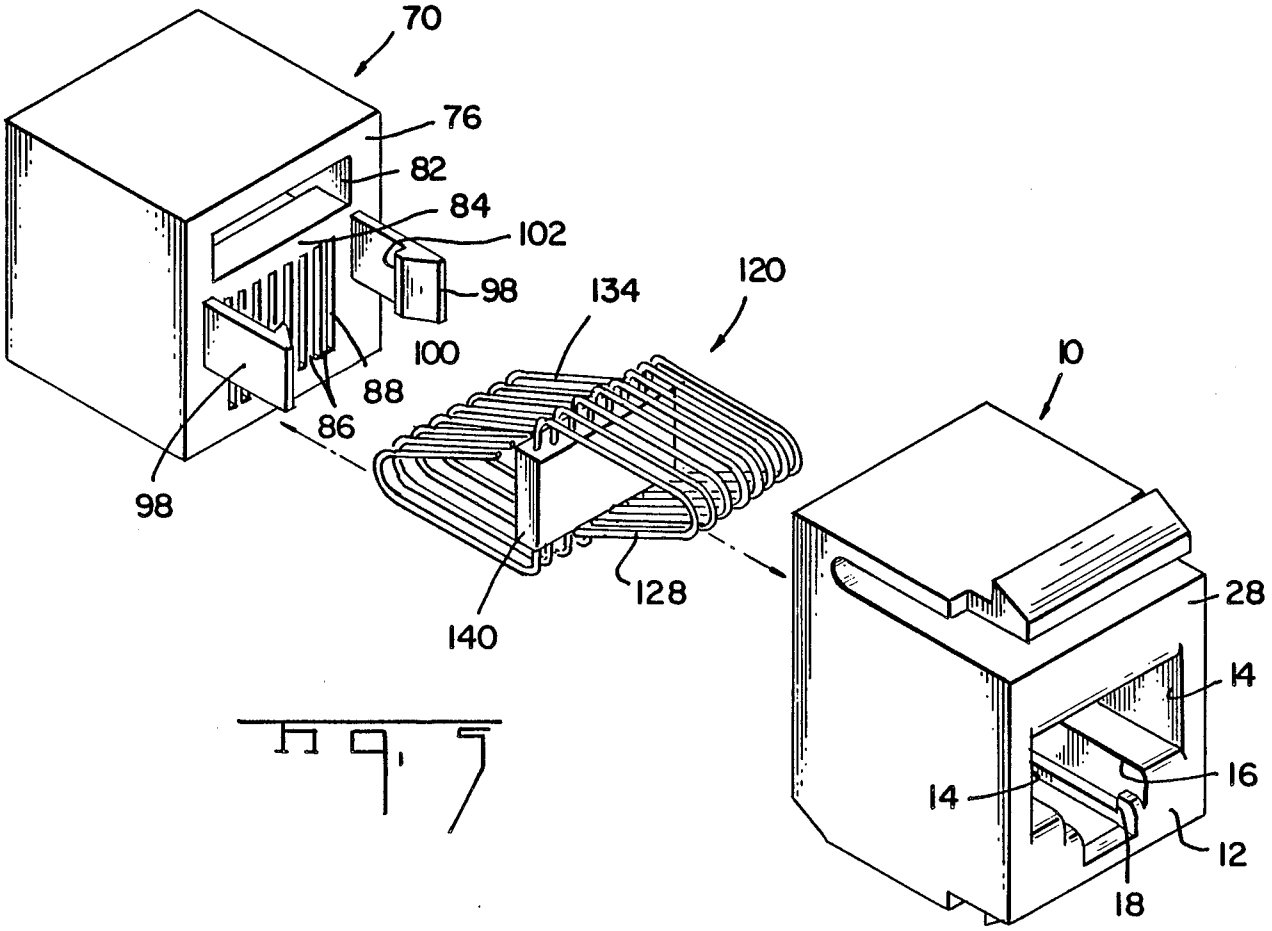

In either embodiment, the inline coupler or the right angle coupler, the web portions 140 and 240 not only encapsulate the terminals to affix the plurality of terminals into a fixed array, but also retain the terminals in a fixed position within the first and second housing members. The webs which affix the wires in a fixed array may be formed via the process disclosed in commonly assigned pending application Ser. No. 088,177 filed Aug. 21, 1987. By placing the web portions 140 and 240 in a parallel relation with the front mating face of the first housing member or transverse to the axial direction, the adapters are easily adaptable one to the other and can incorporate the first housing member in each design. Also, by placing the web portion in a plane which is parallel to the front mating face of the first housing member, the profile of the overall coupler is smaller than the profile of the embodiment shown in FIGS. 1–2.

Figure 12:
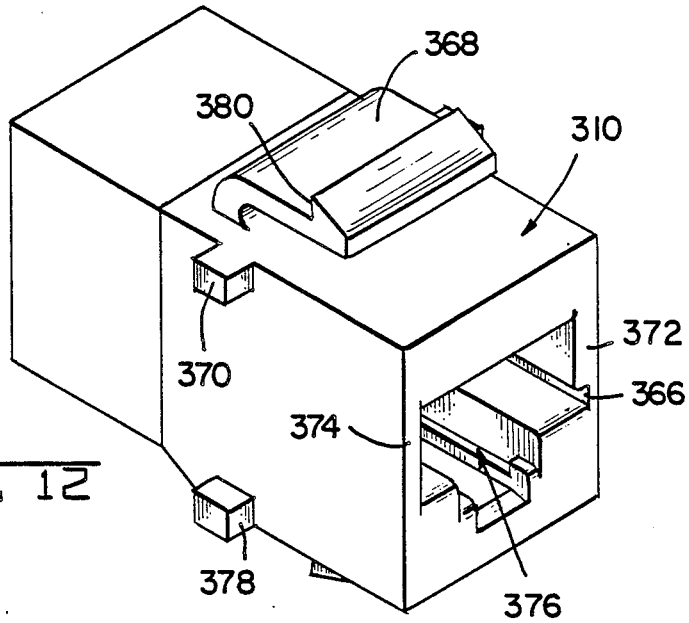
FIG. 12 is an isometric view of a further embodiment.
Figure 13:
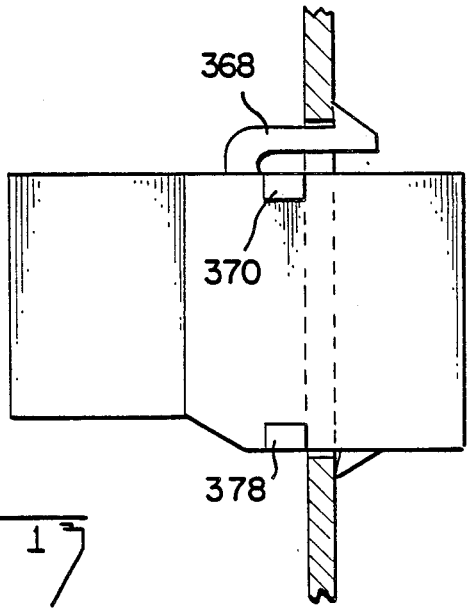
FIG. 13 is a side view of the embodiment shown in FIG. 12.

With reference now to FIG. 12, the subject invention is also available for use with a keyed modular plug such that the key would be provided within the key slot 366. As shown in FIG. 12, the opening 376 for the modular plug is slightly left justified to allow for the key slot 366 which accounts for wall 374 being slightly thinner than wall 372. An alternate housing 310 is used which is similar to the housing 10 shown in FIG. 6 yet includes a somewhat different latching structure. Rather than the latches being totally recessed within the housing, the housing 310 incorporates two windows 360, 362 on either side to accommodate the shift in the opening 376. Said differently, as the opening is shifted to the left as shown in FIG. 12, the latch surface 354 moves to close to the inner side wall to easily mold. Thus by adding windows such as 360 and 362, the latching surfaces 354 on both sides can easily be molded.

FIG. 12 also shows a somewhat different retention feature 368, 370. The housing 310 includes lugs 370 on the sides in cooperation with the resilient latch 368 to allow the coupler to be panel mounted. The latch surface 380 and the front surface 378 of the lugs 370 are spaced cooperatively to a thickness equal to a panel to which it mounts. By molding the housings with variations of lug positions alone can vary the thickness of the panel, while varying the relative positions of the lugs 370 along with the latch surface 380 forwardly or rearwardly can vary the dimension of the front mating face which projects beyond the panel.

The invention was described with reference to FIGS. 3–13 which depict the preferred embodiments of the invention. However, the invention should not be limited to those embodiments shown, the appended claims being attached to that end.

I claim:

1. An electrical coupler which can electrically interconnect two identical electrical plugs, the coupler comprising:

a first insulative housing member comprising a front mating face having a plug receiving opening therein, and a rear face having a pocket recessed from the rear face, the housing further comprising laterally aligned vertical grooves in the rear face which are in transition with channels which extend from the grooves to a position proximate the front mating face;

a second housing member comprising a front mating face having a second plug receiving opening therein, the second housing member having a mounting face which abuts the rear face of the first housing member, and a second plurality of laterally aligned grooves; and a terminal subassembly which includes a plurality of electrically conductive contact elements integrally insert molded and encapsulated within a web of insulative material intermediate the ends of the contact elements, the subassembly being formed with the web profiled slightly smaller than the pocket for receipt within the recessed pocket, with the web and intermediate portions of the contact elements extending parallel to the front mating face, with first sections of the intermediate portions extending from one side edge of the web and disposed within the laterally aligned grooves and thereafter formed to extend forward towards the front mating face, and thereafter reversely bent to extend diagonally inwardly, thereby forming a first plurality of contact members; the terminal subassembly further comprising second sections of the intermediate portions extending from an opposite side of the web as the first said sections, the second 14035A sections forming a second plurality of contact members.

2. The coupler of claim 1 wherein the front mating face of the two housing members are parallel and profiled for receipt of the matable plugs with the plugs oriented in a facing relationship and rotated 180° relative to each other.

3. The coupler of claim 2 wherein the mounting face of the second housing member is a rear face.

4. The coupler of claim 1 wherein the front mating faces of the two housing members are perpendicular and profiled for receipt of the matable plugs when the plugs are at a right angle relative to each other.

5. The coupler of claim 4 wherein the mounting face is a bottom face.

6. The coupler of claim 1 wherein the channels in the first housing member are within a top wall which defines the upper extent of the plug receiving opening.

7. The coupler of claim 6 wherein the conductive contact elements are formed from round wire.

8. An electrical coupler which can electrically interconnect two identical electrical plugs, the coupler comprising:

a first insulative housing member comprising a front mating face having a plug receiving opening therein, and a rear face having a recessed pocket therein, the housing further comprising laterally aligned grooves in the rear face which are in transition with channels which extend from the grooves to a position proximate the front mating face, the housing further comprising at least two apertures extending through the rear face, straddling the said grooves, with access to forwardly facing latch surfaces which are accessible through the plug receiving opening;

a second housing member comprising a front mating face having a second plug receiving opening therein, the second housing member having a second plurality of laterally aligned grooves, the second housing member further comprising a mounting face which abuts the rear face of the first housing member, the mounting face including at least two latching arms extending therefrom, which are insertable through the apertures of the first housing member, the latching arms having latching surfaces which are cooperable with the latch surfaces of the first housing member to retain the first and second housing members together; and a plurality of electrically conductive contact elements, wherein the plurality of conductive contact elements are formed into a terminal subassembly with an integral web insert molded over the contact elements spanning the lateral extent of the contact elements intermediate their ends, with first sections of the contact elements disposed within the laterally aligned grooves, extending forward towards the front mating face, and then reversely bent to extend diagonally inwardly, thereby forming a first plurality of contact members; the contact elements further comprising second sections extending in an opposite direction from the first said sections, the second sections including second reversely bent portions disposed within the second plurality of laterally aligned grooves thereby forming the second plurality of contact members, whereby the web is profiled similar to the pocket for receipt therein of the web and the first and second housing members are latchable one to the other to latch the housings together with the web retentively trapped therebetween.

9. The coupler of claim 8 wherein the front mating faces of the two housing members are parallel and profiled for receipt of the matable plugs with the plugs oriented in a facing relationship and rotated 180° relative to each other.

10. The coupler of claim 9 wherein the mounting face of the second housing member is a rear face.

11. The coupler of claim 8 wherein the front mating face of the two housing members are perpendicular and profiled for receipt of the matable plugs when the plugs are at a right angle relative to each other.

12. The coupler of claim 11 wherein the mounting face is a bottom face.

13. The coupler of claim 8 wherein the channels in the first housing member are within a top wall which defines the upper extent of the plug receiving opening.

* * * * *